United States Patent [19]

Gregg

[11] 4,382,850

[45] May 10, 1983

[54] SOLAR RETORTING OF OIL SHALE

[75] Inventor: David W. Gregg, Morago, Calif.

[73] Assignee: The United States of America as represented by the United States Department of Energy, Washington, D.C.

[21] Appl. No.: 258,352

[22] Filed: Apr. 28, 1981

[51] Int. Cl.[3] ..... C10B 53/06; C10G 1/02; C10B 47/18

[52] U.S. Cl. ..... 208/11 R; 208/8 R; 201/32; 201/44; 202/113

[58] Field of Search ..... 201/32, 44, 48; 202/88, 202/99, 100, 113, 237; 208/8 R, 11 R

[56] References Cited

U.S. PATENT DOCUMENTS 3,058,903 10/1962 Otis ..... 208/11 R 3,475,279 10/1969 Bowman ..... 208/11 R 3,985,037 10/1976 Storrs ..... 208/8 R 3,993,458 11/1976 Antal, Jr. ..... 48/209

*Primary Examiner*—Delbert E. Gantz

*Assistant Examiner*—Glenn A. Caldarola

[57] ABSTRACT

An apparatus and method for retorting oil shale using solar radiation. Oil shale is introduced into a first retorting chamber having a solar focus zone. There the oil shale is exposed to solar radiation and rapidly brought to a predetermined retorting temperature. Once the shale has reached this temperature, it is removed from the solar focus zone and transferred to a second retorting chamber where it is heated. In a second chamber, the oil shale is maintained at the retorting temperature, without direct exposure to solar radiation, until the retorting is complete.

13 Claims, 1 Drawing Figure

SOLAR RETORTING OF OIL SHALE

FIELD OF THE INVENTION

The present invention relates generally to oil shale retorting, and more particularly, to methods and apparatus using solar radiation in oil shale retorting. The United States Government has rights in this invention pursuant to Contract W-7405-ENG-48 between the U.S. Department of Energy and the University of California for the operation of the Lawrence Livermore National Laboratory.

BACKGROUND OF THE INVENTION

The principal part of the organic content of oil shales is an insoluble solid polymeric material normally referred to as "kerogen". A small amount of a soluble organic material, bitumen, is usually found associated with the insoluble kerogen. To generate usable organic products from the shale, the most common process is the thermal decomposition of the initial organic fraction of the rock. At the temperatures conventionally employed, e.g., 500°-1000° C., organic material vaporizes from the shale, leaving a solid organic residue on the inorganic fraction of the shale, the condensible portion of the volatile material in shale oil.

Kerogen in oil shale decomposes by means of the following two-step reaction:

Kerogen→Bitumen→oil+gas+spent shale. Under conventional processing condition, the shale is heated non-isothermally at a rate of a few degrees per minute up to temperatures ranging from 500°-1000° C. It is known, however, that almost all of the conversion occurs between 350° and 550° C. Additionally, the higher the heating rate, the higher the oil yield. Above 550° C., the oil begins to degrade (and the mineral carbonates decompose, consuming energy). The principal nonoxidative ways by which the liberated shale oil can be degraded are cracking and coking reactions. Cracking is defined herein as vapor phase bond fission reactions that eventually lead to a distribution of molecular units (mostly units smaller than the original molecule), plus some carbonaceous residue. Coking is defined herein as liquid or condensed phase reactions resulting in the fusion of two or more molecular species with the ultimate formation of a carbonaceous product, plus minor amounts of lower molecular weight gases.

There are generally two conventional methods for retorting oil shale: combustion front heating; and solid/-solid heat transfer. Combustion front heating provides a slow heating system, resulting in the production of less oil, due to some oil degradation. With solid/solid heat transfer, a solid loop is utilized to effect a heat transfer to the oil shale. The process is more efficient, but very expensive.

Focused solar radiation can be employed in the oil shale retorting process to effect rapid heating and hence a high yield of oil. Additionally, in recent years it has also become recognized that solar energy may be used as the heat source for driving the endothermic char-gasification reaction. For example, U.S. Pat. Nos. 3,993,458 (M. H. Antal, Jr.) and 4,229,184 (David W. Gregg) both disclose the use of solar energy in coal gasification.

Although the use of solar radiation in oil shale retorting is attractive in the sense that the shale can be rapidly heated to a retorting temperature, resulting in a large yield of oil produced, exposure of the oil shale to direct solar radiation during the entire retorting process presents limitations. After the retorting temperature has been reached, the oil shale begins to re-radiate the solar radiation back out through the window from which the radiation originally entered. Additionally, hot spots may form on the oil shale, causing oil degradation and mineral carbonate decomposition.

SUMMARY

Accordingly, an object of the invention is to provide an apparatus and method for retorting oil shale using solar radiation.

Another object of the invention is to provide an apparatus and method for retorting oil shale employing focused solar radiation, wherein re-radiation of solar energy by the oil shale, out through the window from which the radiation was originally introduced, is minimized.

Still another object of the invention is to provide an apparatus and method for retorting oil shale employing focused solar radiation, wherein the time necessary to expose the oil shale to solar radiation is minimized.

Yet another object of the invention is to provide an apparatus and method for retorting oil shale employing focused solar radiation, wherein the effect of forming hot spots on the surface of the oil shale is greatly reduced.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

To achieve the above objects, the oil shale retorting apparatus may comprise a first retorting chamber having a solar focus zone wherein oil shale disposed therein is caused to be brought rapidly to a predetermined retorting temperature. Means are provided for introducing oil shale into the first chamber. A transparent window is set in the first chamber in a position which is adjacent to the solar focus zone. A mirror adapted to reflect, concentrate and direct solar radiation through the window and into the solar focus zone is provided. A second retorting chamber receives the oil shale, which is already at the predetermined retorting temperature, from the solar focus zone, and further maintains it at the retorting temperature for a predetermined length of time. Oil, retorting by-products and spent oil shale are formed. Means are provided for introducing the oil shale from the first chamber to the second chamber. Energy supplying means are included to maintain the oil shale disposed within the second chamber at the retorting temperature. Means for removing the resulting oil, by-product gases, and spent shale from the second retorting chamber are included.

In a further aspect of the present invention, the method for retorting oil shale may comprise introducing oil shale into a first retorting chamber having a solar focus zone. The oil shale is then moved into the solar focus zone, and solar radiation is directed onto the oil shale. The temperature of the oil shale is rapidly raised in the solar focus zone to a predetermined retorting temperature, after which the oil shale is removed from the solar focus zone and introduced into a second retorting chamber. While in the second retorting chamber, the oil shale is maintained at the retorting temperature for a predetermined length of time, resulting in the formation of oil, by-product gases, and spent oil shale. Thereafter, the oil, by-product gases and spent oil shale are separated and removed from the second retorting chamber.

By exposing the oil shale to solar radiation only long enough in the first retorting chamber to rapidly heat it to the retorting temperature, and then continuing to maintain the oil shale at that temperature in a separate chamber without direct exposure to solar radiation, loss of solar radiation from the oil shale is minimized. Additionally, the limited exposure of the oil shale to direct solar radiation reduces the formation of hot spots on the oil shale, and hence a decrease in oil degradation is observed.

DESCRIPTION OF THE DRAWINGS

The accompanying drawing, which is incorporated in and forms a part of the specification, illustrates an embodiment of the present invention, and, together with the Description, serves to explain the principles of the invention.

DETAILED DESCRIPTION

Figure 1:
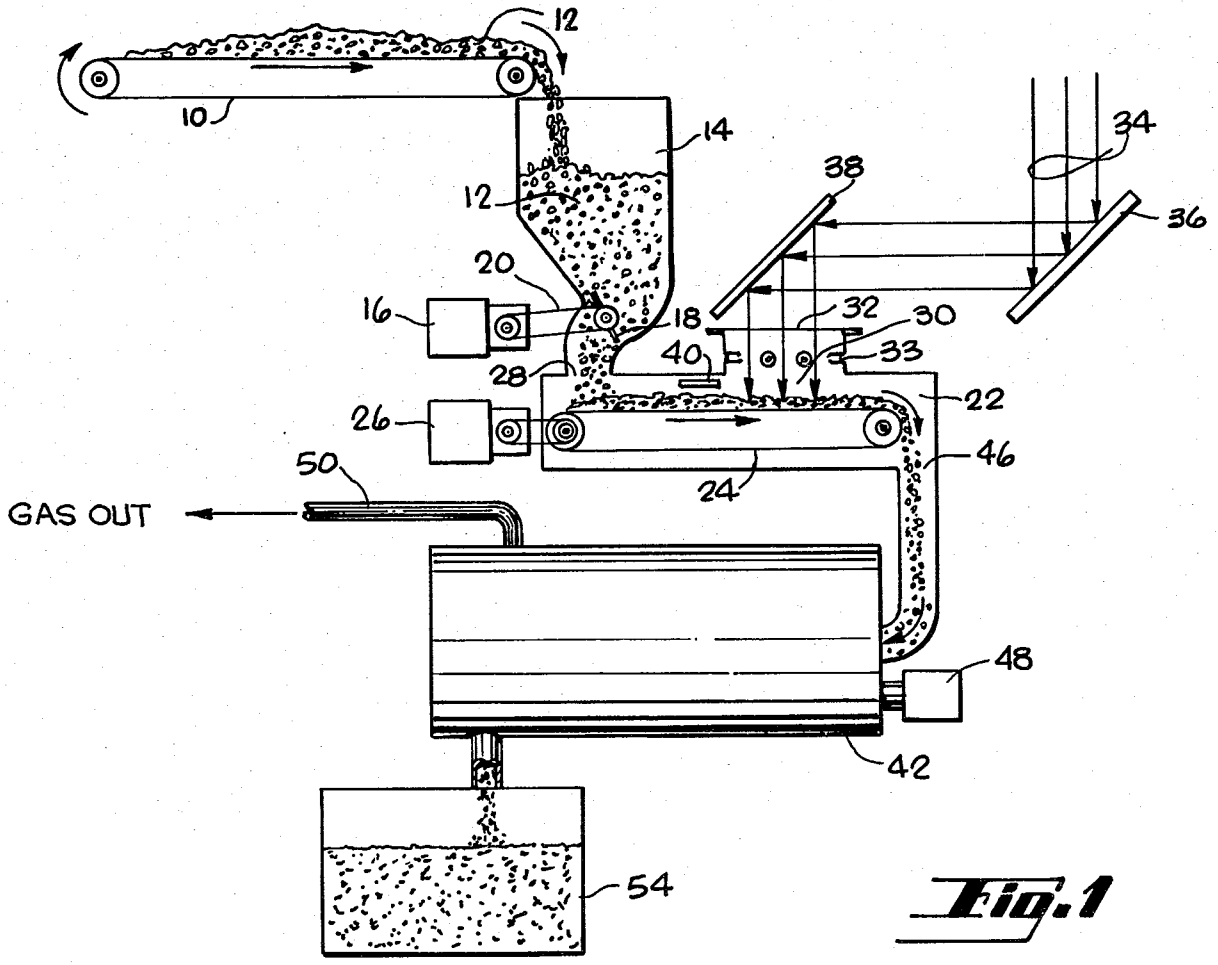
FIG. 1 is a schematic diagram of an oil shale retorting apparatus using solar radiation.

The present invention is the discovery that oil shale can be retorted using solar energy by directly exposing oil shale to solar radiation in a first retorting chamber, and rapidly raising the temperature of the shale to a retorting temperature. The retorting process then continues in a second retorting chamber, where the oil shale is maintained at the retorting temperature until retorting is complete. In the second chamber, the shale is not directly exposed to solar radiation.

Referring now to the oil shale retorting apparatus of FIG. 1, a shale hopper feed 10 introduces oil shale 12 to a hopper 14. Hopper feed 10 may, for example, be a belt driven feed. The oil shale is preferably comprised of particles having a size of no longer than two inches. More preferably, the particles should be one inch or less in diameter. A motor 16 is connected to a feed mechanism 18 which is disposed within hopper 14 by any conventional means. As shown in FIG. 1, a belt pulley system 20 may be employed.

As oil shale 12 exits from hopper 14, it falls onto feeding means 24 which moves it into a first oil shale retorting chamber 22, where it is heated by direct solar radiation. Such means may include vibrators, screw feeders, pneumatic feeders, or, as illustrated in FIG. 1, a belt feeder 24. Belt feeder 24 is actually positioned within chamber 22, and is driven by a belt pulley system 26. The end of chamber 22 adjacent to hopper 14 has an aperture 28 in the side nearest the hopper to permit the introduction of oil shale 12 therein.

At the end of chamber 22, remote from aperture 28, is a solar focus zone 30. Solar focus zone 30 is defined as that area within chamber 22 which is directly exposed to solar radiation. Disposed within chamber 22, in a position adjacent to solar focus zone 30, is a window 32 which allows the passage of solar radiation to the interior of chamber 22. Window 32 is preferably made of quartz or fused silica, for three reasons: (1) it is transparent to the fuel spectrum of solar radiation from the ultraviolet, through the visible, and into the infrared, up to a wavelength of about 4 to 5 $\mu$m; (2) its softening temperature of 1900° K. is well above the necessary retorting temperature of 500° to 550° C.; and (3) it is very resistant to thermal shock.

Belt feeder 24 advances oil shale 12 through chamber 22 and into solar focus zone 30. Solar radiation 34 is collected by an array of heliostats, one of which is shown as mirror 36, and then directed to a primary mirror 38 positioned above window 32. Mirror 36 is capable of rotatable movement to enable the collection of solar energy during the course of the day while the sun's position varies. Mirror 38 then reflects, concentrates and directs solar radiation 34 through window 32, into solar focus zone 30, and onto the surface of oil shale 12 which is nearest window 32. To reduce the small amount of vapors, oil, etc., which may be produced in chamber 22 and coat window 32, the window is preferably raised away from the body of chamber 22. Additionally, injection means 33 are disposed adjacent to window 32 for the purpose of spraying a purging vapor around the window to remove collected oil, vapors, etc. which diminish the window's ability to admit solar radiation. The vapor may be steam, or it may be by-product gases of the retorting process which have been scrubbed and then introduced into solar focus zone 30.

In order to maximize the production of oil from oil shale, it is necessary to provide rapid heating of the shale up to a predetermined retorting temperature. The preferred retorting temperature is from about 500°–550° C. Above 550° C., the oil may undergo coking or cracking, and carbonates may decompose. A thermocouple 40 is positioned within solar focus zone 30, and controls the temperatures within chamber 22. Additionally, belt feeder 24 can be speeded up or slowed down to vary the length of time oil shale 12 is in solar focus zone 30, and hence subjected to solar radiation 34.

When oil shale 23 enters solar focus zone 30, the concentrated solar radiation 34 rapidly raises the temperature of the shale to about 500°–550° C. To complete the retorting process, the shale must remain at this temperature for a period of time depending on the nature of the oil shale, amount present, etc. If, however, the step of maintaining the entire retorting process occurs within solar focus zone 30, then as much as 60% of solar radiation 34 is re-radiated from oil shale 12 back out through window 32, and is wasted. Additionally, if oil shale 12 remains within solar focus zone 30 for the length of time necessary to complete the retorting, hot spots begin to develop on the side of oil shale 12 which is nearest window 32. Thus, although the overall temperature of oil shale 12 may be within the retorting temperature range of 500°–550° C., certain spots will be much hotter, resulting in the degradation of the oil as previously described. In order to minimize these problems, a second retorting chamber 42 is provided. The purpose of chamber 42 is to maintain the oil shale at the retorting temperature after it has first been heated quickly to the retorting temperature. Oil shale 12 remains within chamber 42 until oil, gas or by-products such as $H_2$ and $CH_4$ and spent oil shale are produced. If window 32 is about 8 inches in diameter, then residence times of from 10 to 30 seconds in chamber 22, and 200 to 300 seconds in chamber 42 are preferred. Of course, the residence times will also depend on the type and quality of oil shale, and the amount retorted.

Chamber 42 is positioned nearly adjacent to solar focus zone 30. A conduit 44 provides the means for introducing the shale from one chamber to the next. Oil shale 12 advances on belt feeder 24 through solar focus zone 30, and is quickly heated to the retorting temperature therein by solar radiation 34. It is then dumped off feeder 24, falls through an aperture 46 within the bottom section of chamber 22 into conduit 44, and finally enters chamber 42.

Chamber 42 is preferably a rotary kiln surrounded by a layer of insulation. A thermocouple (not shown) is disposed within chamber 42 to monitor the interior temperature. Chamber 42 can be heated by a variety of methods, including conventional electrical means; the use of solar energy wherein solar radiation is caused to heat the chamber itself, but does not actually enter the chamber; and finally retorting by-product gases such as $CH_4$ and $H_2$ which may be combusted to provide the necessary heat. Once the oil shale has entered chamber 42, it is advanced therein from one end to the other by conventional means such as a screw feeder 48. The oil, by-product gases and spent shale formed in chamber 42 are collected, separated and removed from the chamber. The gas by-products and oil vapors are removed through conduit 50, and spent shale is collected in receiver 54.

It is estimated that about 80% of the total energy necessary for the retorting operation will be supplied in rapidly heating the oil shale to the retorting temperature in chamber 22, and the remaining 20% in chamber 42.

It may also be desirable to preheat the oil shale to a temperature of about 250° to 350° C. before it is introduced into chamber 42. For this purpose, the excess heat found within the spent oil shale can be used to preheat the fresh oil shale. This is achieved by bringing the spent shale in heat exchange relationship with the fresh oil shale. The fresh oil shale (at a preheat temperature of about 250° to 350° C.) is then introduced into hopper feed 10. Additionally, conventional gas heating or electrical means may be employed to preheat the oil shale.

The foregoing description of a preferred embodiment of the invention has been presented for purposes of illustration and description. It is not intended to be exhaustive or to limit the invention to the form disclosed, and obviously many modifications and variations are possible in light of the above teaching. The embodiments were chosen and described in order to best explain the principles of the invention and its practical application, to thereby enable others skilled in the art to best utilize the invention in various embodiments, and with various modifications as are suited to the particular use contemplated. It is intended that the scope of the invention be defined by the claims appended hereto.

I claim:

1. An oil shale retorting apparatus comprising:

a first retorting chamber having a solar focus zone wherein oil shale disposed therein is rapidly brought to a predetermined retorting temperature without forming hot spots on said oil shale;

means for introducing oil shale into said first chamber;

a transparent window set in said first chamber adjacent said solar focus zone, said window being transparent to substantially all solar radiation;

a mirror adapted to reflect, concentrate, and direct solar radiation through said window into said solar focus zone;

a second retorting chamber, said second chamber receiving oil shale already at said retorting temperature from said solar focus zone, and further maintaining said oil shale at said retorting temperature for a pedetermined length of time, wherein oil, by-product gases, and spent oil shale are formed;

means for introducing said oil shale from said first chamber into said second chamber;

heating means for providing energy to said second chamber to maintain said oil shale disposed therein at said retorting temperature; and means for removing said oil, by-product gases, and spent oil shale from said second chamber.

2. The oil shale retorting apparatus of claim 1, additionally comprising a means for spraying a purging vapor around said window.

3. The oil shale retorting apparatus of claim 1, additionally comprising a thermocouple disposed within said solar focus zone.

4. The oil shale retorting apparatus of claim 1, wherein said second chamber is a rotary kiln.

5. The oil shale retorting apparatus of claim 1, additionally comprising means for preheating said oil shale before it is introduced into said first chamber.

6. The oil shale retorting apparatus of claim 1, wherein said window is in a spaced-apart relationship from said solar focus zone.

7. A method for retorting oil shale comprising:

introducing oil shale into a first retorting chamber having a solar focus zone;

moving said oil shale into said solar focus zone;

directing solar radiation into said solar focus zone and onto said oil shale;

rapidly raising the temperature of said oil shale in said solar focus zone to a predetermined retorting temperature;

removing said oil shale at said retorting temperature from said solar focus zone before hot spots form on said oil shale, and moving it to a second retorting chamber;

maintaining said oil shale within said second chamber at said retorting temperature for a predetermined length of time by applying additional heat;

forming oil, by-product gases, and spent oil shale in said second chamber;

separating oil, by-product gases, and spent oil shale; and removing said oil, by-product gases, and spent oil shale from said second chamber.

8. The method for retorting oil shale according to claim 7, wherein said oil shale in said second chamber is maintained at said retorting chamber without direct exposure to solar radiation.

9. The method for retorting oil shale according to claim 7, wherein said oil shale is preheated before it is introduced into said first chamber.

10. The method for retorting oil shale according to claim 7, wherein said retorting temperature is about 500° to 550° C.

11. The method of retorting oil shale according to claim 7, wherein said oil shale remains in said solar focus zone for about 10 to 30 seconds.

12. The method of retorting oil shale according to claim 7, wherein said oil shale remains in said second chamber for about 200 to 300 seconds.

13. The method of retorting oil shale according to claim 7, wherein said by-product gases are utilized to heat said second chamber.

* * * * *